US009388692B2

(12) United States Patent
Taylor et al.

(10) Patent No.: US 9,388,692 B2
(45) Date of Patent: Jul. 12, 2016

(54) DUST COLLECTION SYSTEM FOR A MACHINE

(71) Applicant: Caterpillar Global Mining America LLC, Houston, PA (US)

(72) Inventors: Benjamin P. Taylor, Blacksburg, VA (US); James W. Coe, Jr., Rocky Gap, VA (US)

(73) Assignee: Caterpillar Global Mining America LLC, Houston, PA (US)

( * ) Notice: Subject to any disclaimer, the term of this patent is extended or adjusted under 35 U.S.C. 154(b) by 430 days.

(21) Appl. No.: 13/955,323

(22) Filed: Jul. 31, 2013

(65) Prior Publication Data

US 2015/0034392 A1 Feb. 5, 2015

(51) Int. Cl.

| | |
|---|---|
| ***E21B 21/015*** | (2006.01) |
| ***E21D 20/00*** | (2006.01) |
| ***E21B 21/00*** | (2006.01) |

(52) U.S. Cl.

CPC ..... *E21D 20/003* (2013.01); *E21B 21/015* (2013.01); *E21C 7/00* (2013.01)

(58) Field of Classification Search

CPC ..... E21B 21/015; E21B 19/087; E21B 21/07; E21C 7/00; E21D 20/00; E21D 20/003; B23Q 11/0071

See application file for complete search history.

(56) References Cited

U.S. PATENT DOCUMENTS

| | | | | | |
|---|---|---|---|---|---|
| 2,914,031 | A | * | 11/1959 | Fuehrer | E21B 19/087 173/152 |
| 3,319,727 | A | * | 5/1967 | Pyles | E21B 21/07 173/27 |
| 4,300,642 | A | | 11/1981 | Perraud | |
| 4,710,064 | A | * | 12/1987 | Stafford | E21D 23/0086 405/288 |
| 5,462,311 | A | † | 10/1995 | Cipolla | |
| 5,794,721 | A | * | 8/1998 | Clonch | E21D 20/003 175/170 |
| 6,148,474 | A | † | 11/2000 | Ohara | |
| 6,598,688 | B2 | | 7/2003 | Wang | |
| 2012/0024607 | A1 | | 2/2012 | Swope et al. | |
| 2013/0183111 | A1 | * | 7/2013 | Lerch | B23Q 11/0071 408/56 |
| 2015/0034392 | A1 | * | 2/2015 | Taylor | E21C 7/00 175/209 |

OTHER PUBLICATIONS

Parts Catalog for J.H. Fletcher & Co. Mining Product Published prior to July 31, 2012.†

* cited by examiner
† cited by third party

*Primary Examiner* — Daniel P Stephenson

(57) ABSTRACT

A dust collection tube arrangement is provided. The tube arrangement includes an outer tube and an inner tube. The outer tube and the inner tube have a hollow configuration. The inner tube has a diameter lesser than that of the outer tube. The inner tube moves fore and aft with respect to the outer tube. The outer and inner tubes provide a passage for dust and airflow along with adjustable length of tube arrangement based on a position of the inner tube with respect to the outer tube.

13 Claims, 6 Drawing Sheets

DUST COLLECTION SYSTEM FOR A MACHINE

TECHNICAL FIELD

The present disclosure relates to a dust collection system, and more specifically to the dust collection system used in a mining machine.

BACKGROUND

During operation of a mining machine, such as, for example, a roof bolter, dust is generated due to performance of drilling and bolting tasks. The dust is collected and transported from a dust generation area proximate to a drill mast of the roof bolter, to a dust delivery area which is present at a rear side of the roof bolter. Accordingly, tubes or hoses are provided along a length of the roof bolter for conveying and providing a passage for the dust and airflow from the dust generation area to the dust delivery area on the roof bolter.

Known hose designs include providing the hoses in a looped arrangement associated with some sections of the roof bolter, like a drill boom of the machine. However, the hoses of the said design have a bulky arrangement. These hoses are exposed to cuts, abrasions or premature failures during the operation of the roof bolter in a confined mine space. This may cause the roof bolter to be inoperable in compliance with government regulations, thereby further affecting machine productivity due to loss of time.

U.S. Published Application Number 2012/0024607 relates to a dust collecting device disposed circumferentially around a roof tool and in association with a roof drill bit and slidable thereon for collecting and removing the dust generated during a dry drilling operation. The dust collecting device comprises a cylinder member, a bushing, and a mounting assembly comprising a top washer, a rubber insert, and a bottom washer.

SUMMARY OF THE DISCLOSURE

In one aspect of the present disclosure, a dust collection tube arrangement is provided. The tube arrangement includes an outer tube and an inner tube. The outer tube and the inner tube have a hollow configuration. The inner tube has a diameter lesser than that of the outer tube. The inner tube is configured to move fore and aft with respect to the outer tube. Further, the outer and inner tubes provide a passage for dust and airflow such that a length of the tube arrangement is adjustable based on a position of the inner tube with respect to the outer tube.

In another aspect, a dust collection system is provided. The dust collection system includes an inner tube and an outer tube. The outer and inner tubes have a hollow configuration. A diameter of the outer tube is more than that of the inner tube. The dust collection system also includes a sealing means. The sealing means is positioned at an interface of the inner tube and the outer tube. The sealing means provides sliding movement of the inner tube within the outer tube. A combination of the inner tube and the outer tube provides a contiguous passage with variable length for the dust and airflow.

In yet another aspect, a dust collection system for a roof bolter is provided. The dust collection system includes a dust inlet hose and a dust outlet hose. The dust collection system also includes a dust collection arrangement. The dust collection arrangement is connected to the dust inlet hose and the dust outlet hose. The dust collection arrangement also includes an inner tube and an outer tube. The outer and inner tubes have a hollow configuration. The outer tube is affixed to a frame of a roof bolter and has a diameter larger than that of the inner tube. The inner tube is configured to move fore and aft with respect to the outer tube to provide dust and airflow passage with variable length.

DETAILED DESCRIPTION

Figure 1:
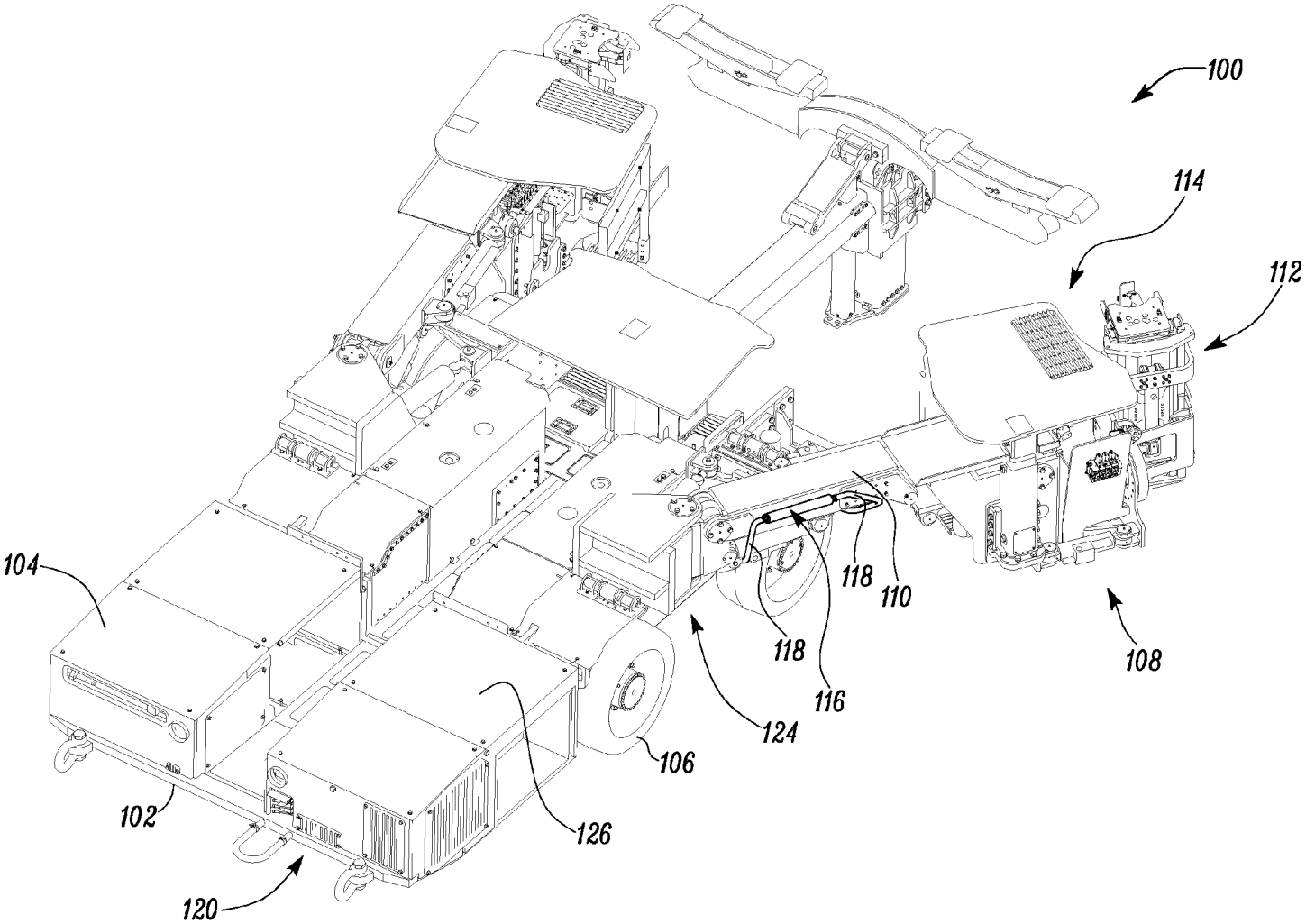
FIG. 1 is a perspective view of an exemplary mining machine, according to one embodiment of the present disclosure.

Wherever possible, the same reference numbers will be used throughout the drawings to refer to the same or the like parts. Referring to FIG. 1, an exemplary mining machine 100 is illustrated. More specifically, the machine 100 is a roof bolter. The machine 100 may be configured for supporting a section of roof of a mine and/or a tunnel during a roof bolting operation. The machine 100 may also be configured for performing the roof bolting operation using suitable rock drilling and bolting tools. It should be noted that the machine 100 may include any other machine having a dust collection system associated with the machine 100.

The machine 100 includes a chassis or a frame 102. An enclosure 104 is provided on the frame 102. The enclosure 104 houses a power source (not shown). The power source may be any conventional or non-conventional power source including, but not limited to, an internal combustion engine, power storage devices like batteries, electric motor and the like. The power source may be configured to provide power to the machine 100 for mobility and/or other operational needs. The enclosure 104 may also house various other components required for operational control of the machine 100 including, but not limited to, electrical and/or electronic components, hydraulic and/or pneumatic components and the like.

Further, ground engaging members 106 such as wheels or tracks may be provided on the machine 100 for the purpose of mobility. A drivetrain (not shown) is coupled to the power source and the ground engaging members 106. The drivetrain may include any one or a combination of, but not limited to, gearing, differentials, drive shafts and hydraulic and/or pneumatic circuits including valves, lines, distribution manifolds and the like. The drivetrain may be configured to transmit power from the power source to the ground engaging members 106.

The machine 100 includes a drill boom segment 108. The drill boom segment 108 is pivotally coupled to the frame 102 of the machine 100. The drill boom segment 108 may include an extendable arm 110 in order to pivotally couple the drill boom segment 108 to the frame 102 of the machine 100. The drill boom segment 108 may include a drill mast 112. The drill mast 112 is configured to perform the rock bolting operation using suitable rock drilling and bolting tools. The drill boom segment 108 also includes an operator platform 114. The operator platform 114 may be provided with various controls which are used by an operator to control the drill boom segment 108.

The drill mast 112 may include a drill head (not shown). A dust collector (not shown) may be employed in an area surrounding the drill head. The dust collector is configured to collect the dust generated as a result of performing the drilling operation. The dust may be pulled into at least a portion of the dust collector to create a flow having the dust particles suspended within air. Further, the dust collector is connected to a tube arrangement 116 associated with a dust collection and delivery system of the machine 100.

The term "dust collection and delivery system" used herein refers to a plurality of hoses 118 or tubes, as well as the tube arrangement 116 provided in the present disclosure. The dust collection and delivery system provides a contiguous passage for conveying the dust and airflow from a dust generation area, i.e. the drill mast 112 of the machine 100, to a dust delivery area, i.e. a rear section 120 of the machine 100. The hoses 118 provided along the length of the machine 100 may be made of any suitable material. In one embodiment, a polymer such as, for example, polyurethane, polyethylene, synthetic or natural rubber and so on may be utilized to form the hoses 118. These hoses 118 are hollow in shape for allowing the passage of the dust and airflow. Parameters related to the hoses 118 such as length, location, shape, diameter, size, material and the like may vary as per system requirements.

Figure 2:
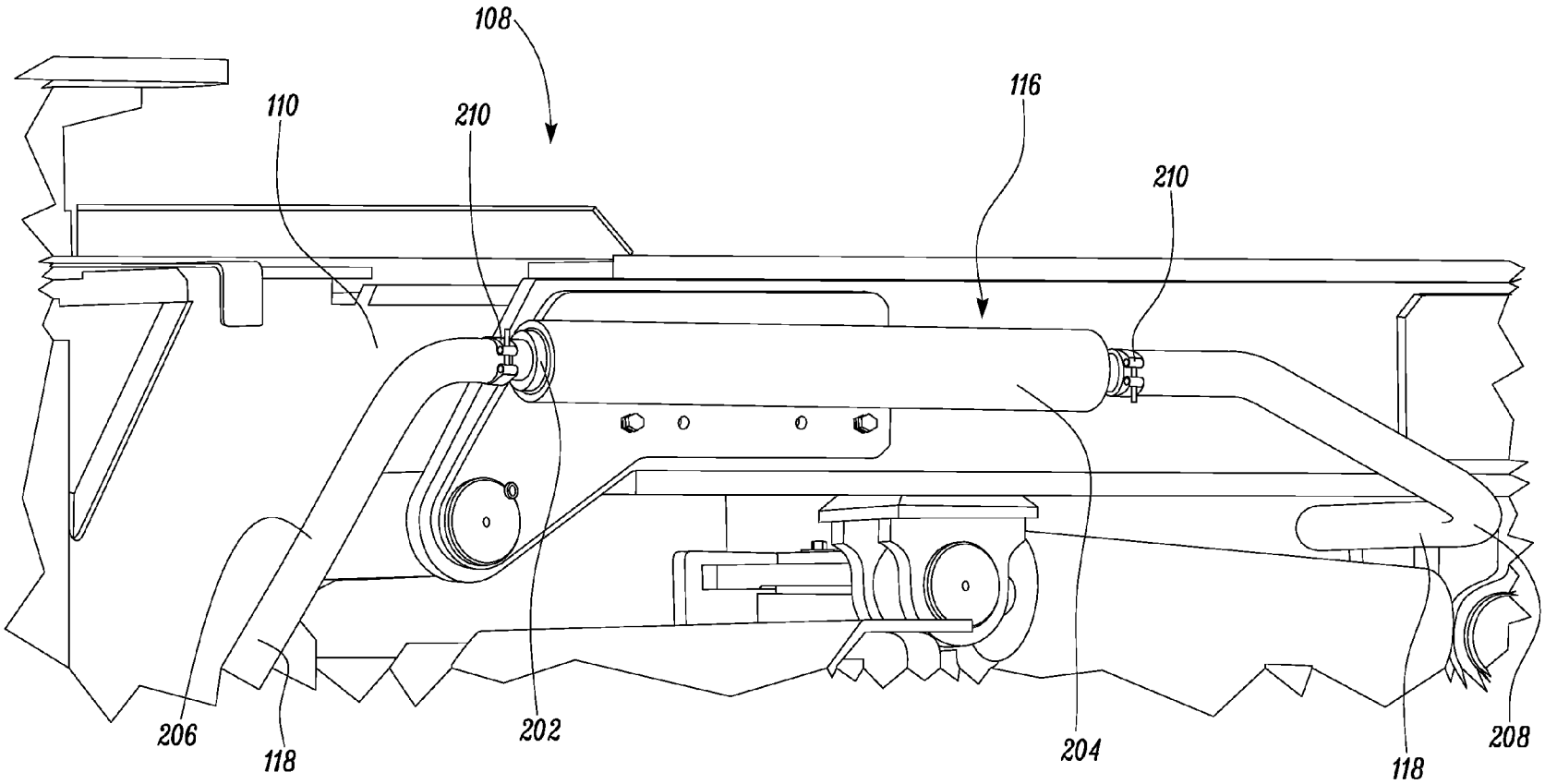
FIG. 2 is a perspective view of a tube arrangement in a retracted position, the tube arrangement being provided on a drill boom segment of the machine.
Figure 3:
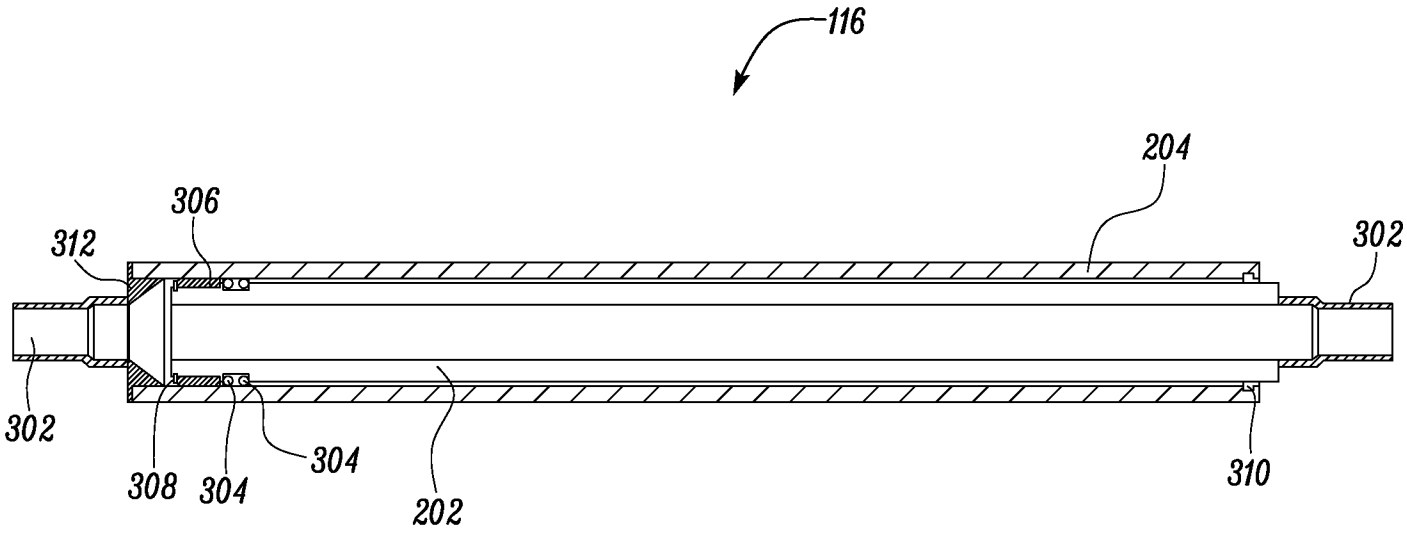
FIG. 3 is a cross sectional view of the tube arrangement shown in FIG. 2, the tube arrangement being in the retracted position.
Figure 4:
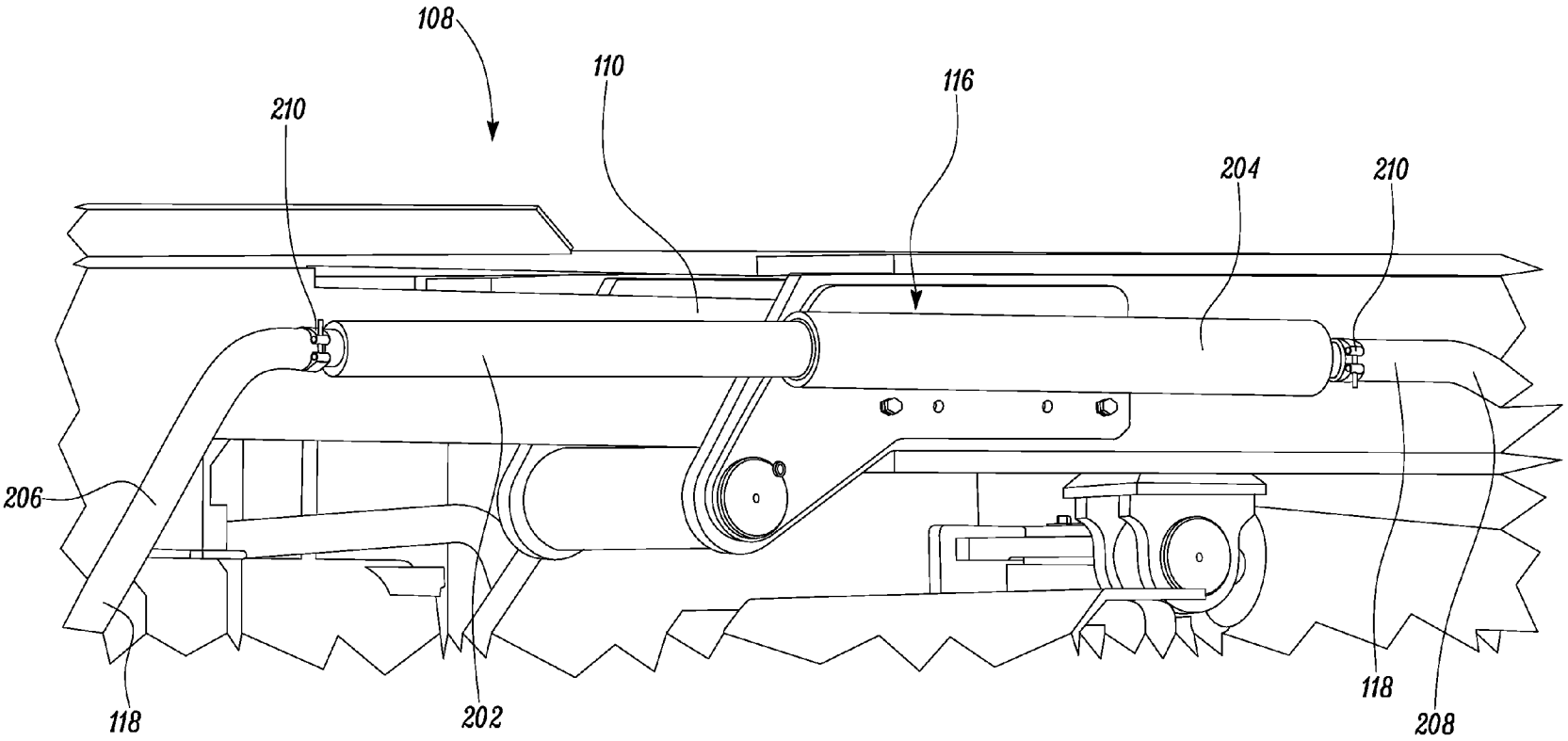
FIG. 4 is a perspective view of the tube arrangement in an extended position on the drill boom segment of the machine.
Figure 5:
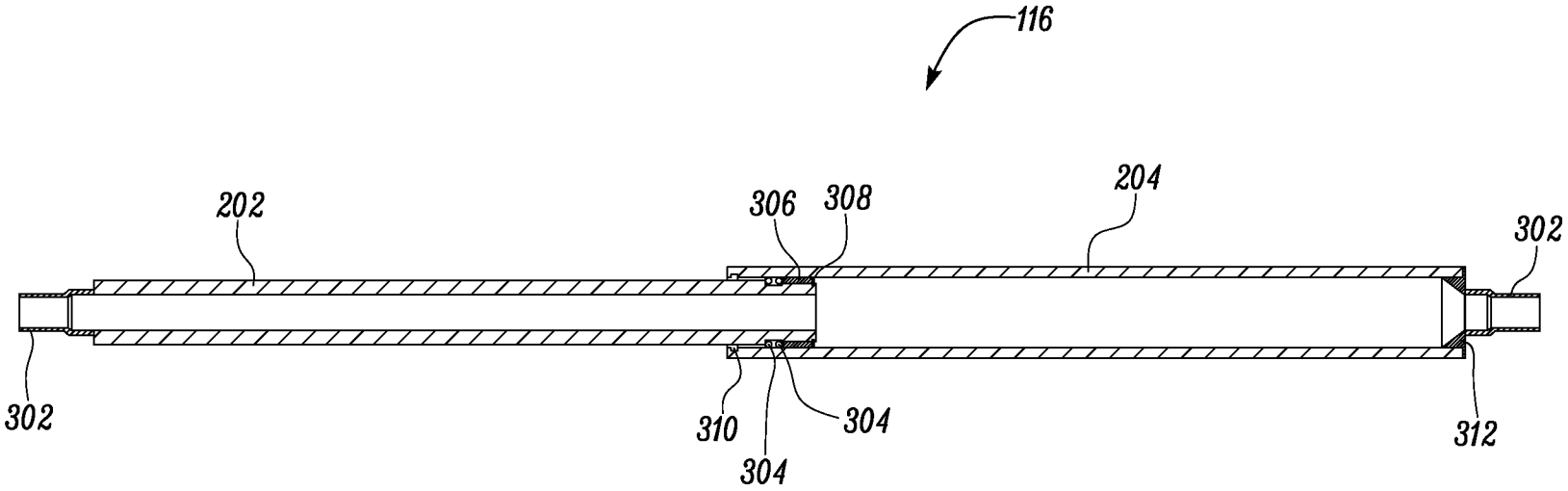
FIG. 5 is a cross sectional view of the tube arrangement shown in FIG. 4, the tube arrangement being in the extended position.
Figure 6:
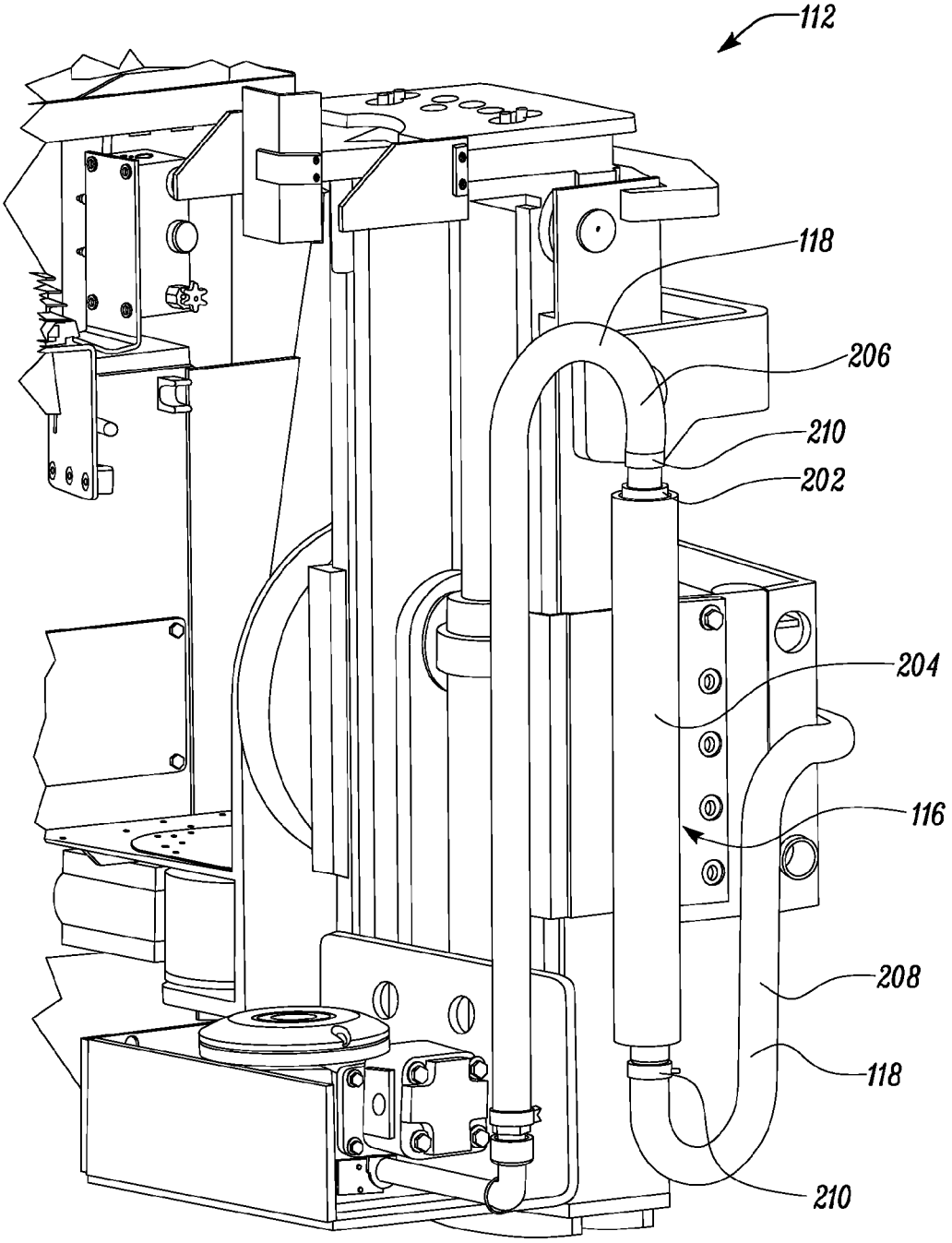
FIG. 6 is a perspective view of the tube arrangement provided on a drill mast of the machine.

In one embodiment of the present disclosure, as shown in FIGS. 1, 2 and 4, the tube arrangement 116 may be provided in connection with the drill boom segment 108 of the machine 100. In another embodiment, as illustrated in FIG. 6, the tube arrangement 116 may be associated with the drill mast 112 of the machine 100. The working of the tube arrangement 116 will be described in detail in connection with FIGS. 2 to 6.

Referring to FIG. 1, the tube arrangement 116 provided on the machine 100 is connected to the hoses 118. The dust and airflow may pass through the tube arrangement 116 and may be further connected to a pre-duster (not shown) via the hoses 118. The pre-duster is configured to separate relatively larger dust particles from the dust and airflow. In one embodiment, the pre-duster uses a cyclone air stream to perform the separation. At least a portion of the separated dust may be released into the atmosphere from a bottom section 124 of the machine 100.

A remaining portion of the dust and airflow may be allowed to flow through the hoses 118 and other associated components like hose unions (not shown) to a dust box 126 present on the machine 100. Due to a large volume of space provided by the dust box 126, the dust may separate out from airflow and settle at a bottom of the dust box 126. In one embodiment, the dust box 126 may contain a series of filters (not shown) such that the dust is captured by the filters.

Further, after the dust is separated and collected in the dust box 126, clean air may be pulled from the dust box 126 through the hoses 118 into a blower (not shown). A vacuum pressure may be created in the dust collection and delivery system due to the pulling or suction effect. A muffler (not shown) is connected to the blower. The air from the blower may flow to the muffler. Further, the air may exit the machine 100 through the muffler.

FIG. 2 illustrates the tube arrangement 116 associated with the drill boom segment 108 of the machine 100. The tube arrangement 116 includes an inner tube 202 and an outer tube 204. The inner tube 202 and the outer tube 204 have a hollow configuration. The hollow configuration of the tube arrangement 116 provides the contiguous passage for the dust and airflow to pass through the tube arrangement 116. More particularly, the outer tube 204 is positioned in a manner at least partially surrounding the inner tube 202.

FIG. 3 illustrates a cross-sectional view of the tube arrangement 116 shown in FIG. 2. As shown, a diameter of the inner tube 202 is substantially lesser than that of a diameter of the outer tube 204, allowing for the inner tube 202 to be at least partially positioned within the outer tube 204. The inner tube 202 is configured to move fore and aft with respect to the outer tube 204. Hence, the tube arrangement 116 provides the passage of variable length based on a position of the inner tube 202 with respect to the outer tube 204.

Referring to FIG. 2, the outer tube 204 is fixedly attached to the frame 102 of the machine 100. In the illustrated embodiment, the tube arrangement 116 is affixed to the drill boom segment 108. The outer tube 204 is affixed using any known method such as, for example, welding, riveting, bolting or using a known external support structure like a bracket or clamp. The inner tube 202 is attached to an extendable portion, i.e. the extendable arm 110 of the drill boom segment 108. Alternatively, in another embodiment, a configuration of the tube arrangement 116 may be reversed such that the inner tube 202 is affixed to the frame 102 and the outer tube 204 is attached to the extendable portion, based on system requirements.

In the present disclosure, the inner tube 202 is configured to move fore and aft with respect to the outer tube 204. Based on the position of the inner tube 202 with respect to the outer tube 204, the length of the tube arrangement 116 may vary. FIGS. 2 and 3 show the tube arrangement 116 in a retracted position, in which the inner tube 202 is entirely within the outer tube 204. FIGS. 4 and 5 depict the tube arrangement 116 in an extended position, in which a majority of the length of the inner tube 202 lies outside that of the outer tube 204.

Further, the movement of the inner tube 202 within the outer tube 204 is based on a movement of the extendable arm 110 of the drill boom. For example, in this case, the movement of the inner tube 202 in the tube arrangement 116, associated with the drill boom segment 108 is in a horizontal direction, such that the inner tube 202 is drawn out of the outer tube 204 to change from the retracted position to the extended position, when the drill boom segment 118 is moved outwards with respect to the frame 102 of the machine 100. The inner and outer tubes 202, 204 may be made of any suitable metal which provides required stiffness for the given structure.

As shown in the accompanying figures, a nozzle 302 may be provided at one end of the inner tube 202 and a corresponding other end of the outer tube 204 in order to connect the tube arrangement 116 with a dust inlet hose 206 and a dust outlet hose 208 of the dust collection and delivery system respectively. Also, any other union or joining component may also be utilized.

Further, a retention mechanism 210 such as, a crimp fitting, a push fitting or a clamp fitting may be employed for connecting the dust inlet and dust hoses 206, 208 to the inner and outer tubes 202, 204 respectively. Further, a sealing means may be provided at an interface of the inner and outer tubes 202, 204. The sealing means may include an O-ring 304. The sealing means may be made of a material different than that used to form the inner and outer tubes 202, 204.

Further, in one embodiment, a bushing 306 may be provided proximate to the O-ring 304. The bushing 306 is provided for allowing the inner tube 202 to slide with respect to the outer tube 204 without allowing an outer surface of the inner tube 202 to interfere or rub against an inner surface of the outer tube 204. Additionally, a retention ring or a snap ring 308 may be provided proximate to the bushing 306. This may prevent the bushing 306 from slipping out of place from the tube arrangement 116. In another embodiment, a shaft wiper 310 may be provided proximate to the one end of the inner tube 202, for guiding the movement of the inner tube 202 within the outer tube 204. Also, a mechanism for stopping or preventing the inner tube 202 from sliding out of the outer tube 204 is provided at the other end of the outer tube 204. For example, as shown in FIGS. 3 and 5, a stopper 312 having a funnel shaped cavity is positioned at the other end of the outer tube 204 and the nozzle 302. The shape of the cavity may facilitate a smooth transition in diameter from the inner tube 202 to the outer tube 204.

FIGS. 4 and 5 depict the tube arrangement 116 in the extended position, wherein the length of the tube arrangement 116 is comparatively longer than that shown in FIGS. 2 and 3. It should be noted that the length of the tube arrangement 116 may change between the extended and the retracted positions of the inner tube 202 with respect to the outer tube 204, based on the movement of the associated drill boom segment 108.

As shown in FIG. 6, the tube arrangement 116 may be associated with the drill mast 112 of the machine 100, such that outer tube 204 is fixed to the drill mast 112. The inner tube 202 is attached to the extendable portion of the drill mast 112. As described earlier, the inner tube 202 is configured to move fore and aft with respect to the outer tube 204 based on the movement of the drill mast 112. In this situation, the extension and retraction in the length of the tube arrangement 116 is in a vertical direction. In the illustrated embodiment, the dust inlet hose 206 is connected to the inner tube 202 and the dust outlet hose 208 is connected to the outer tube 204 respectively. It should be noted that these connections may vary based on system requirements. Also, the position, location and orientation of the tube arrangement 116 described herein is merely on an exemplary basis and does not limit the scope of the present disclosure.

INDUSTRIAL APPLICABILITY

Dust is conveyed from one portion of the machine to another through dust carrying hoses. Known designs include providing a looped structure for the dust carrying hoses. This arrangement occupies a significant amount of space. Also, the dust carrying hoses are exposed to cuts and abrasions. This may lead to premature failure of the dust carrying hoses.

The tube arrangement 116 provided in the present disclosure provides a robust configuration having the passage of variable length for the dust and airflow to pass through. The length of the passage is based on the position of the inner tube 202 with respect to the outer tube 204.

The dust and airflow may enter into the tube arrangement 116. Based on the position of the drill boom segment 108 and/or the drill mast 112, the position of the inner tube 202 with respect to the outer tube 204 may vary. Accordingly, the length of the tube arrangement 116 may change based on the movement of the inner tube 202 with respect to the outer tube 204. The dust and airflow may exit the tube arrangement 116 and flow into the associated hoses 118 of the dust collection and delivery system.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A dust collection tube arrangement, the tube arrangement comprising:

an outer tube having a hollow configuration; and an inner tube having a hollow configuration, the inner tube having a diameter lesser than that of the outer tube, the inner tube configured to move fore and aft with respect to the outer tube;

wherein the outer and inner tubes are configured to provide a passage for dust and airflow, such that a length of the tube arrangement is adjustable based on a position of the inner tube with respect to the outer tube;

wherein the tube arrangement is associated with a drill mast of a roof bolter, the outer tube being attached to the drill mast and the inner tube being attached to an extendable portion; and wherein the movement of the inner tube within the outer tube is based on a movement of the drill mast.

2. The tube arrangement of claim 1 further comprising a sealing means provided at an interface of the inner tube and the outer tube.

3. The tube arrangement of claim 2, wherein the outer and inner tubes are made of a first material and the sealing means is made of a second material, the second material being different from that of the first material.

4. The tube arrangement of claim 1, wherein one end of each of the inner and outer tubes includes a nozzle for connection with a dust inlet hose and a dust outlet hose.

5. The tube arrangement of claim 1, wherein the tube arrangement is associated with a drill boom segment of a roof bolter, the outer tube being attached to a main drill boom and the inner tube being attached to an extendable portion.

6. The tube arrangement of claim 5, wherein the movement of the inner tube within the outer tube is based on a movement of the main drill boom.

7. The tube arrangement of claim 1, wherein a length of the inner tube is equal to or greater than a length of the outer tube.

8. A dust collection system comprising:

an inner tube having a hollow configuration;

an outer tube having a hollow configuration, a diameter of the outer tube being more than that of the inner tube; and a sealing means positioned at an interface of the inner tube and the outer tube, the sealing means being provided such that the inner tube is slidable within the outer tube;

wherein a combination of the inner and outer tubes provides a contiguous passage having a variable length for dust and airflow;

wherein the dust collection system is associated with a drill mast of a roof bolter, the outer tube being attached to the drill mast and the inner tube being attached to an extendable portion; and wherein the sliding of the inner tube within the outer tube is based on a movement of the drill mast.

9. The system of claim 8, wherein the outer and inner tubes are made of a first material and the sealing means is made of a second material, the second material being different from that of the first material.

10. The system of claim 8, wherein one end of each of the inner and outer tubes includes a nozzle for connection with a dust inlet hose and a dust outlet hose.

11. The system of claim 8, wherein the dust collection system is associated with a drill boom segment of a roof bolter, the outer tube being attached to a main drill boom and the inner tube being attached to an extendable portion.

12. The system of claim 11, wherein the sliding of the inner tube within the outer tube is based on a movement of the main drill boom.

13. The system of claim 8, wherein a length of the inner tube is equal to or greater than a length of the outer tube.

* * * * *